US008984669B2

(12) United States Patent
Song

(10) Patent No.: US 8,984,669 B2
(45) Date of Patent: Mar. 24, 2015

(54) HOSIERY WITH PADDED SOLES

(71) Applicant: Jennie Song, Newington, CT (US)

(72) Inventor: Jennie Song, Newington, CT (US)

( * ) Notice: Subject to any disclaimer, the term of this patent is extended or adjusted under 35 U.S.C. 154(b) by 32 days.

(21) Appl. No.: 13/862,504

(22) Filed: Apr. 15, 2013

(65) Prior Publication Data

US 2013/0333096 A1 Dec. 19, 2013

Related U.S. Application Data

(60) Provisional application No. 61/659,575, filed on Jun. 14, 2012.

(51) Int. Cl.

| | |
|---|---|
| ***A41B 11/00*** | (2006.01) |
| ***A41B 11/02*** | (2006.01) |
| *A41D 13/06* | (2006.01) |

(52) U.S. Cl.

CPC ..... *A41B 11/007* (2013.01); *A41B 11/02* (2013.01); *A41D 13/06* (2013.01)

USPC ..... 2/239

(58) Field of Classification Search

CPC ..... A41B 11/007; A41B 11/02; A41D 13/06

USPC ..... 2/239, 240, 241, 242, 267; 128/894; 36/43, 44, 71, 153

See application file for complete search history.

(56) References Cited

U.S. PATENT DOCUMENTS

| | | | | |
|---|---|---|---|---|
| 1,581,067 | A * | 4/1926 | Kleindienst | 2/240 |
| 2,075,610 | A * | 3/1937 | Hemingway | 66/182 |
| 3,128,763 | A * | 4/1964 | Langenfeld et al. | 128/894 |
| 5,497,789 | A * | 3/1996 | Zook | 128/893 |
| 5,671,482 | A | 9/1997 | Alvera | |
| 5,737,776 | A | 4/1998 | Jennings | |
| 6,275,997 | B1 | 8/2001 | Richardson | |
| 6,381,755 | B2 * | 5/2002 | Cortani | 2/239 |
| 6,944,974 | B2 * | 9/2005 | Falone et al. | 36/44 |
| 7,103,922 | B1 * | 9/2006 | Doorley | 2/409 |
| 8,205,271 | B2 | 6/2012 | Canci | |
| 2008/0034479 | A1 * | 2/2008 | Barnett | 2/241 |
| 2008/0301860 | A1 * | 12/2008 | Iqbal | 2/455 |
| 2012/0066815 | A1 * | 3/2012 | Feeman-Fick | 2/239 |
| 2014/0090273 | A1 * | 4/2014 | Piontkowski | 36/44 |

* cited by examiner

*Primary Examiner* — Khoa Huynh
*Assistant Examiner* — Anna Kinsaul
(74) *Attorney, Agent, or Firm* — Daniel Boudwin; Global Intellectual Property Agency LLC

(57) ABSTRACT

A hosiery device having gel pads disposed along the bottom. The device has at least one leg portion with a footed portion disposed at the bottom. It may be a pair of leggings such as pantyhose or may be a single leg stocking. Gel pads are integrated into the bottom of the footed portions in key areas that correspond to load-bearing portions of a user's foot. The gel pads are formed around the underlying hosiery fabric, creating an integrated pad that is not easily removable. Pads may be positioned along the ball, heel, toes, or entire sole of the foot. The device provides therapeutic relief of muscle tension and stress by cushioning the parts of the foot that bear a person's weight.

11 Claims, 3 Drawing Sheets

HOSIERY WITH PADDED SOLES

CROSS REFERENCE TO RELATED APPLICATION

This application claims the benefit of U.S. Provisional Application No. 61/659,575 filed on Jun. 14, 2012, entitled "Silicon Gel-Padded Hosiery." The patent application identified above is incorporated here by reference in its entirety to provide continuity of disclosure.

BACKGROUND OF THE INVENTION

1. Field of the Invention

The present invention relates to a therapeutic hosiery device. More specifically, it relates to a pair of footed leggings having padded regions along the ball and/or heel of the foot. The device is worn like pantyhose or any other type of footed legging and provides padded comfort to the soles of a user's feet while the device is in use. It will be appreciated by people who wear uncomfortable shoes throughout their working day in addition to leggings or pantyhose.

Most men and women have had occasion to discover that work appropriate shoes and formal footwear are uncomfortable to wear. Dress shoes often feature fashionable but oddly shaped toe regions, high heels, and little instep support. Because of these limitations, extended wear of dress footwear is often uncomfortable or even painful. Those who must wear dress shoes to work every day frequently experience discomfort throughout the day and are relegated to bringing a second pair of footwear with them to work so that they can change into more comfortable shoes.

Other people place insole padding in their shoes to cushion the bottoms of their feet. These pads present several problems. Unsecured insole cushions slide around underneath a user's feet. The insole cushions can slide into awkward positions or cause a user's feet to slide within their shoes, either of which can result in stumbling or tripping. Some insole pads are secured via adhesive to the bottom of a shoe interior and cannot be easily transferred to another pair of shoes. Thus a user must have multiple sets of insole cushions to accommodate their collection of dress shoes. An insole cushion device is needed that can be worn with multiple dress shoes and will stay in place during wear.

2. Description of the Prior Art

The present invention is a pair of footed leggings that have built in pads on the bottom of the foot portions. The pads cover the ball and heel of a user's foot to alleviate pressure in these regions. The legging may be nylon hosiery, cotton tights, or any other type of footed legging. The device thus provides a padded cushioning for a user's feet that is integrated discretely into a pair of leggings. The prior art fails to describe padding that is integrated into a work-appropriate garment and thus does not disclose the structure of the present invention.

Canci, U.S. Pat. No. 8,205,271 discloses a stocking or sock that has pockets disposed along the sole region. Pads of various shapes, sizes and thickness are inserted into the pockets to provide different regions of a user's foot with protective cushioning. The device can be a stocking such as pantyhose or can be a pair of socks. Users select and insert the cushion pads, and then remove them as the pad becomes worn or soiled. Unlike the present invention, the Canci device does not prevent pads from sliding around under a user's foot. The pads of the present device are integrated into the stocking to reduce slippage and keep cushioning in place under a user's feet.

A comfort stocking is described in Alvera, U.S. Pat. No. 5,671,482 for providing protection to the sole of a user's foot. The stocking is made of nylon and has a reinforced slipper shaped region on the footed portion of the stocking. The reinforced region may include the use of cotton or similar threads woven into the nylon thread of the stocking. Alvera does not disclose any pads or cushioning, and instead uses a soft thicker thread on the foot portion to increase comfort to a user. While the reinforced foot region might provide increased comfort, it does not provide cushioned support to a user's feet. The present invention specifically addresses the need for sole support by integrating pads into the sole region of the foot. These pads are placed in specific locations rather than as a whole foot cover.

Other devices pertain to footwear and hosiery that have pads secured to the bottom of the feet regions. Jennings, U.S. Pat. No. 5,737,776 discloses a pair of stockings having a multi-layered pad secured to the bottom of each foot. These pads have a wicking, moisture absorbent layer that absorbs moisture from the bottom of a user's foot. A traction layer is secured to the bottom of the wicking layer to prevent a user's foot from sliding around within a shoe. The multi-layer pad is secured to the bottom of the stocking, making it easy for the pad to peel off with wear. Richardson, U.S. Pat. No. 6,275,997 teaches a sock that has a number of small gel-filled nubs secured to the bottom of the sock. The gel-filled nubs are disposed all along the bottom of the sock to cushion the user's feet from impact with the ground. The sock is intended for use by runners or athletes who are frequently on their feet. Like the Jennings device the nubs of Richardson are secured to the bottom of a user's feet and can be easily worn off or peeled away over time. The present invention integrates a cushioned pad into the stocking material to prevent the pad from being worn away.

The prior art fails to disclose a stocking or legging that has a gel-filled pad integrated into the fabric of the garment. Nor do the device disclose cushioned pads located at specific load-bearing regions of a user's foot. The present invention substantially diverges in design elements from the prior art and consequently it is clear that there is a need in the art for an improvement to existing therapeutic hosiery devices. In this regard the instant invention substantially fulfills these needs.

SUMMARY OF THE INVENTION

In view of the foregoing disadvantages inherent in the known types of therapeutic hosiery now present in the prior art, the present invention provides a new integrated gel padding wherein the same can be utilized for providing convenience for the user when cushioning the load bearing portions of a user's feet.

The therapeutic hosiery device of the present invention is designed to address the problem of alleviating discomfort associated with wearing dress shoes. The device can be a pair of leggings joined at the top or individual stockings such as calf or knee high hose. Footed portions are disposed at the bottom of each stocking or each leg of the leggings. These footed portions are shaped to accommodate a user's feet. Along the bottom of the footed portions, gel pads are integrated into the material of the device. The pad is formed around the fabric, with an upper surface exposed to the bottom of a user's foot and a bottom surface exposed to the interior of a shoe. This integration provides direct contact with a user's feet and the shoe, reducing the potential for feet to slide around within the footed region or the shoe.

Gel pads can be placed in multiple configurations. One gel pad covers the ball of a user's foot, another covers the heel area. There may also be a gel pad extending along the entire sole of a user's foot. In an alternative embodiment the footed portion has two separate areas for the big toe and four smaller toes. This embodiment allows users to wear thong sandals with the hosiery device. Additional gel pads may be disposed between the big toe portion and the portion containing the other four toes. This prevents the thong of a sandal from chaffing the space between a user's toes.

It is therefore an object of the present invention to provide a new and improved therapeutic hosiery device that has all of the advantages of the prior art and none of the disadvantages.

It is another object of the present invention to provide customized placement of gel pads to cushion different parts of a user's feet.

Another object of the present invention is to provide a hosiery device that cushions a user's feet while reducing the likelihood that the feet will slide around within the hosiery or a pair of shoes.

Yet another object of the present invention is to provide a cushioned hosiery device that can be work as a pair of leggings or as individual stockings. Thus a user can wear stockings with different padding configurations on each foot if so desired.

A further object of the present invention is to provide a cushioned hosiery device having a split toe region so that users can wear thong sandals with the hosiery.

A still further object of the present invention is to provide hosiery with an integrated gel pad that cannot be easily worn away by general use.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 2:
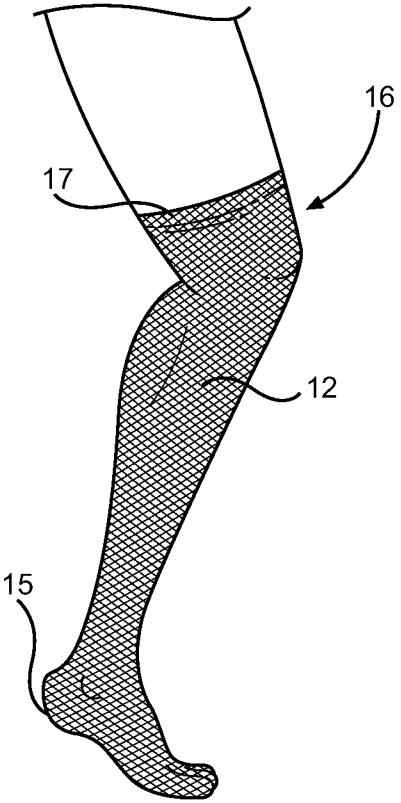
FIG. 2 Shows a side view of the thigh-high stocking embodiment of the device.

Reference is made herein to the attached drawings. Like reference numerals are used throughout the drawings to depict like or similar elements of the therapeutic hosiery device. For the purposes of presenting a brief and clear description of the present invention, the preferred embodiment will be discussed as used for cushioning the soles of a user's feet. The figures are intended for representative purposes only and should not be considered to be limiting in any respect.

Figure 1:
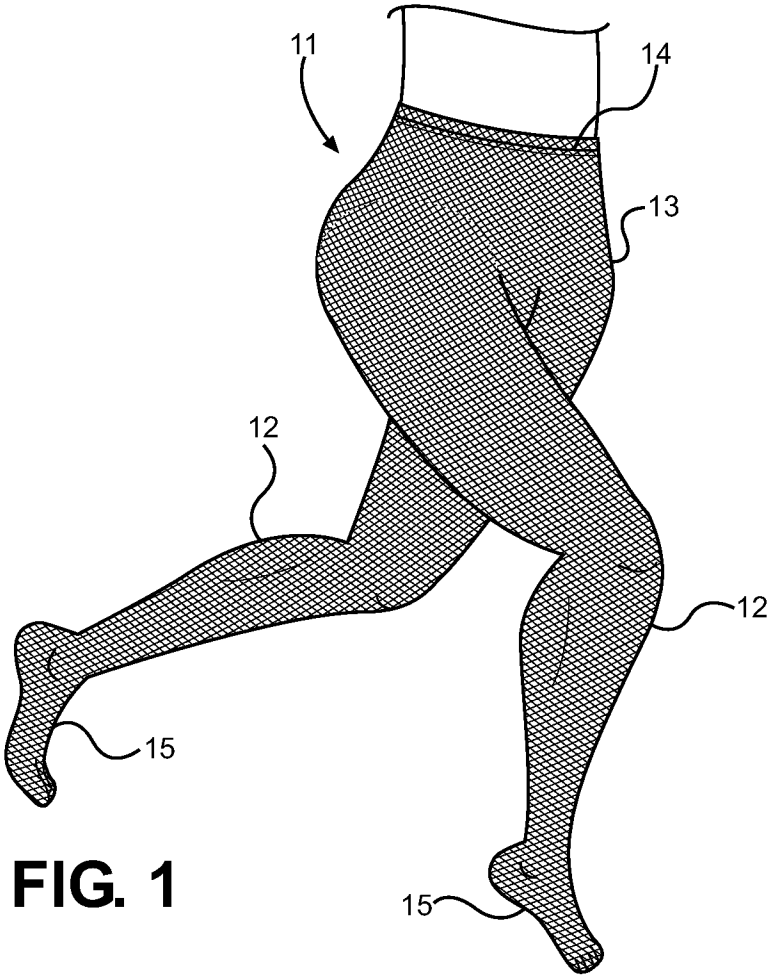
FIG. 1 shows a side view of the pantyhose/leggings embodiment of the device.

Referring now to FIG. 1, there is shown a therapeutic hosiery device in the shape of a pair of pantyhose 11. It has two leg portions 12 joined together at the top to form a panty region 13. The panty region covers a user's abdomen and is secured in place by an elastic band 14 that sits around the user's waist. At the bottom of each leg portion is a footed portion b15 that is generally shaped like a human foot in order to receive and accommodate a user's feet. The device can be nylon pantyhose, or any other material that is used in the construction of form fitting leggings.

Another embodiment of the device is shown in FIG. 2 as a thigh-high stocking. The stocking 16 covers only one of a user's legs rather than both legs as in the embodiment in FIG. 1. Like the leggings embodiment the single leg version of the device also has a leg portion 12 that sheaths a part of a user's leg, and a footed portion 15 that covers the user's foot. A leg waistband 17 is disposed at the top of the stocking and may be elastic to help hold the device up or may simply be reinforced material to prevent fraying. Though a thigh-high stocking is shown in the figure, the single leg embodiment may extend from the feet to any portion of a user's leg. Thus, knee high stockings and dress socks are also contemplated for manufacture. Stockings, leggings, and pantyhose are known in the art and the basic construction of the hosiery product will be known to one of ordinary skill in the art.

Figure 3:
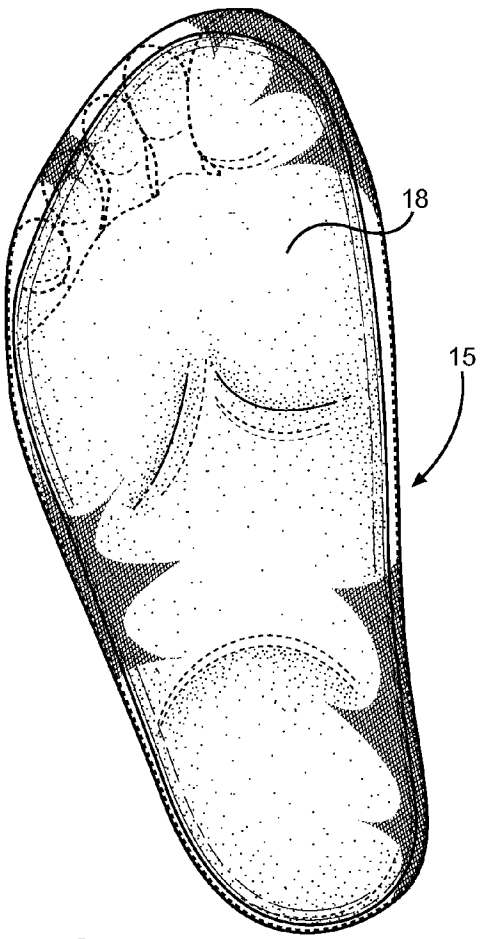
FIG. 3 shows an underside view of the foot portion of the therapeutic hosiery device.

Turning now to FIG. 3, the bottom of the footed portion 15 is shown in detail. The footed portion covers a user's foot and toes in the same material as the rest of the legging. A user's toes are covered by the front most part of the footed portion, while the back covers a user's heel. A ball cushion 18 made of a solidified gel substance is disposed along the part of the footed region that covers the ball of the user's foot. The ball cushion provides a thick region of deformable gel material to cushion a user's foot from impacts and disperse load-bearing tension. Positioning of the gel pad is not limited to the ball region. The pads can be aligned with any load-bearing region of the foot or may cover the entire underside of the sole. Size and shape of the cushions can vary according to the size of the underlying hosiery product.

Figure 4:
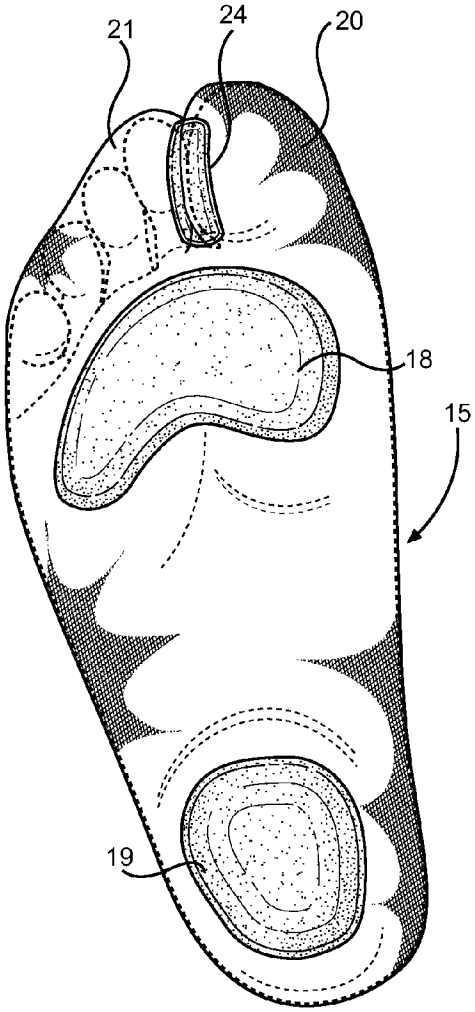
FIG. 4 shows an underside view of an alternative embodiment of the therapeutic hosiery device, having a split toe region.

A second configuration of the gel pads is shown in FIG. 4. A ball cushion 18 is disposed on the underside of the footed portion 15. On the back of the footed portion, aligned with a user's heel is a heel cushion 19. This cushion protects the heel of the foot while the user is walking or standing. It will be appreciated by people who wear flat heel or low-heel dress shoes where load bearing is done by both the ball and heel of a user's foot. The ball cushion is particularly important to users who wear high hells because the ball of the foot bears most of the user's weight during walking or standing. Additionally, the heel portion may be present without the ball portion. Such a configuration will be useful to users with heel spurs or other heel conditions that make standing on the heel painful.

Also shown in FIG. 4 is an alternative embodiment of the device having a split toe portion at the front of the footed portion 15. The big toe is enclosed within a big toe portion 20 and a small toe portion 21 covers the remaining toes. This embodiment presents two separate areas that retain different toes so that users can comfortably wear thong sandals. Thong sandals generally include a thong strap that rests between a user's big toe and index toe. Wearing these shoes with conventional hosiery is difficult because the garment does not allow the thong to slide into the space between the toes. The split toe region of the present invention solves this problem by creating a gap between the big toe and index toe where a thong can rest. In a further alternative embodiment, small toe gel pads 24 may be disposed along the space between the big toe region and small toe region to cushion the user's toes from a sandal thong. This embodiment lessens abrading of the soft skin between a user's toes while sandals are worn.

Figure 5:
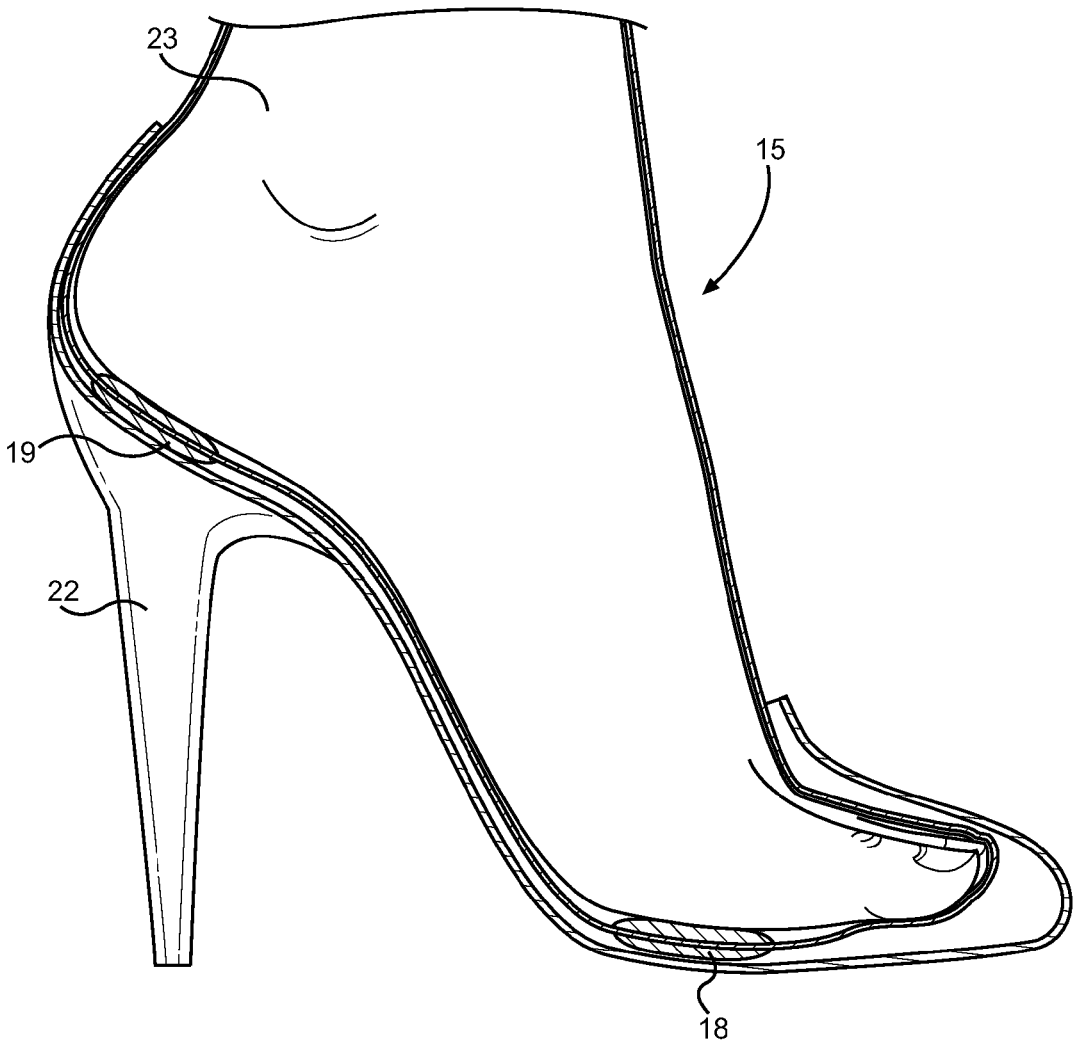
FIG. 5 shows a cross-sectional view of the therapeutic hosiery device in user with a pair of women's dress shoes.

Referring now to FIG. 5 a cross-section of the multi-pad version of the invention is shown. The user is wearing a high-heeled shoe 22 that causes the foot 23 to tilt downward, placing most of the user's weight on the ball of the foot. Gel pads 18, 19 are positioned along the bottom of the footed portion 15 to provide comfort to the heel and ball of the foot. The gel pads are formed around the threads of the hosiery material. This results in an gel pad upper surface that is exposed to a user's foot and a gel pad lower surface that is exposed to the shoe interior, with the hosiery trapped therebetween. Constructing gel pads in this manner is advantageous because it integrates the pad into the underlying fabric, making it difficult for the pad to peel away over time. Additionally, gel based cushioning materials are generally tacky to the touch, creating a non-slip surface. The exposed upper surface of the pad clings gently to the skin of a user's foot, so the foot doesn't slide around within the garment. Similarly, the lower surface of the pad clings to the interior of the shoe, helping to keep the user's foot in place throughout the day.

In use an individual places her foot into the footed portion of the garment and pulls the leg portion upward so that it covers the appropriate part of the leg. In the leggings embodiment the user repeats this step with the other leg and then pulls the panty portion up to the waist. Then the user can adjust the placement of gel pads along the soles of her feet by physically manipulating the footed portion. Once the pads are in a desired location, the user slides the foot into a dress shoe. The individual can then walk and stand comfortably without worrying that the pads will slide out of place or bunch up within the shoe.

The present invention is a therapeutic hosiery device that comes in several shapes including leggings, thigh-high stockings, knee-high stockings and dress socks. Each leg portion of the device sheaths a part of the user's leg and has a footed portion at the bottom. Gel pads are integrated into the bottom of the footed portion and formed around the underlying material. The pads have an upper and lower surface that contact the user's foot and shoe interior respectively. The gel pads cushion the user's feet, protecting them from injury due to uncomfortable dress shoes. In this way, the invention reduces muscle aches, pains and stress injuries, and improves overall foot health.

Any form-fitting stretch fabric can be used in the construction of the hosiery product. Fabrics with porous, absorbent fibers are recommended as well as wide or loose weave fabrics. Such fabrics permit the gel to seep through the fabric threads, trapping them inside the pad during creation of the gel pads. Gel pads of different types may be used as cushions. The type of gel used and thickness of the pad may vary to meet the needs of varied users. For example, pads for everyday wear might be thinner and smaller in diameter than pads for people with heel spurs or foot injuries. The present invention facilitates both preventive foot care as well as support for already existing foot injuries, thereby allowing people with injured feet to continue wearing work appropriate footwear while the injury heals.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A therapeutic hosiery device, comprising:

at least one leg portion having a footed portion at a lower end thereof, the footed portion having an interior to contact a wearer's foot and an exterior to contact a wearer's shoe;

at least one pad made of gel material having an upper surface and a lower surface, wherein the gel material of the at least one pad is disposed on a bottom of the footed portion and is integrated through said footed portion such that the upper surface of said at least one pad is exposed on the interior of the footed portion and the lower surface of said at least one pad is exposed on the exterior of the footed portion, and wherein the footed portion surrounded by the gel material is trapped within said at least one pad.

2. The therapeutic hosiery device of claim 1, further comprising:

a panty portion adapted to extend over a user's abdomen and buttocks;

wherein said at least one leg portion comprises two leg portions, said two leg portions extending from said panty portion.

3. The therapeutic hosiery device of claim 1, wherein said at least one pad is secured to said footed portion in an area aligning with a ball of a user's foot.

4. The therapeutic hosiery device of claim 1, wherein said at least one pad is secured to said footed portion in an area aligned with a heel of a user's foot.

5. The therapeutic hosiery device of claim 1, wherein said at least one pad is secured along the entirety of a bottom surface of said footed portion.

6. A therapeutic hosiery device, comprising:

at least one leg portion having a footed portion at a lower end thereof, the footed portion having an interior to contact a wearer's foot and an exterior to contact a wearer's shoe;

said footed portion having a big toe portion and a small toe portion; wherein said big toe portion and said small toe portion are separated by a gap formed in the exterior of the footed portion;

at least one pad made of gel material having an upper surface and a lower surface, wherein the gel material of the at least one pad is disposed on a bottom of the footed portion and is integrated through said footed portion such that the upper surface of said at least one pad is exposed on the interior of the footed portion and the lower surface of said at least one pad is exposed on the exterior of the footed portion, and wherein the footed portion surrounded by the gel material is trapped within said at least one pad.

7. The therapeutic hosiery device of claim 6, further comprising: a panty portion adapted to extend over a user's abdomen and buttocks; wherein said at least one leg portion comprises two leg portions, said two leg portions extending from said panty portion.

8. The therapeutic hosiery device of claim 6, where said at least one pad is secured to said footed portion in an area aligning with a ball of a user's foot.

9. The therapeutic hosiery device of claim 6, wherein said at least one pad is secured to said footed portion in an area aligned with a heel of a user's foot.

10. The therapeutic hosiery device of claim 6, wherein said at least one pad is secured along the entirety of a bottom surface of said footed portion.

11. The therapeutic hosier device of claim 6, further comprising at least one small toe pad made of gel material secured between said big toe portion and said small toe portion.

* * * * *